United States Patent [19]

Manfuso, Jr.

[11] 4,096,870

[45] Jun. 27, 1978

[54] METHOD FOR CLEANING SOFT HYDROPHILIC GEL CONTACT LENSES

[75] Inventor: John A. Manfuso, Jr., Chevy Chase, Md.

[73] Assignee: Burton, Parsons and Company, Inc., Washington, D.C.

[21] Appl. No.: 805,147

[22] Filed: Jun. 9, 1977

[51] Int. Cl.[2] ..... B08B 3/08

[52] U.S. Cl. ..... 134/28; 134/42; 252/136, 252/DIG. 12, 264/1

[58] Field of Search ..... 134 28, 42: 252/106, 252/136, DIG. 12, 264/1

[56] References Cited

U S PATENT DOCUMENTS

| | | | |
|---|---|---|---|
| 3,697,451 | 10/1972 | Mausner et al | 252/DIG. 12 X |
| 3,723,327 | 3/1973 | Kampen et al. | 252/DIG. 12 X |
| 3,798,181 | 3/1974 | Vazquez | 252/DIG. 12 X |
| 3,855 142 | 12/1974 | Pader et al. | 252/DIG. 12 X |
| 3,910,296 | 10/1975 | Karageozian et al. | 134/42 X |
| 3,962,107 | 6/1976 | Levin et al. | 252/DIG. 12 X |

OTHER PUBLICATIONS

The Merck Index, 8th ed., 1968, p. 780.

*Primary Examiner*—Richard V. Fisher
*Assistant Examiner*—Marc L. Caroff
*Attorney, Agent, or Firm*—Fidelman, Wolffe & Waldron

[57] ABSTRACT

Proteinaceous material on the surfaces of hydrophilic gel contact lenses is removed by contacting the lenses with an aqueous suspension of pancreatin without absorption of pancreatin into the lens structure. Pancreatin is formulated as tablets using sodium chloride and boric acid as binding agents thus providing a convenient, measured amount of pancreatin for cleaning a single pair of contact lenses.

7 Claims, No Drawings

METHOD FOR CLEANING SOFT HYDROPHILIC GEL CONTACT LENSES

BACKGROUND OF THE INVENTION

This invention relates to a method for cleaning soft hydrophilic gel contact lenses which are often referred to as "soft lenses". More particularly, this invention relates to a method for cleaning soft contact lenses which have become coated with proteins, lipids, fats or other similar contaminants during use, particularly during wear in the eyes and during handling.

The use and wear of contact lenses involves contact with body tissues and tissue fluids which in turn results in the formation of deposits in the form of superficial films. Such deposits tend to alter the physical surface characteristics, including mechanical effects such as coefficients of friction and the like, wetting characteristics, appearance and color, odor and the like. The deposit film also presents a growth medium for potentially dangerous bacteria, fungi, and other pathological organisms. Surface cleanliness, then, has a direct, apparent significance, both functional and aesthetic, to the user of a prosthesis.

Conventional physical and chemical cleaning techniques are uniformly undesirable and in many situations become extremely deleterious. Physical techniques involve an intolerable degree of abrasion which will roughen the surface of a prosthesis to one degree or another. This type of surface effect is harmful to both the appearance and the performance of a prosthesis and increases the tenacity with which surface films will subsequently attach by virtue of the increased "tooth" or roughness of the surface. Without abrasive mechanical assistance, chemical cleaning techniques which may be safely employed are generally ineffective.

Chemical techniques also are susceptible to leaving a surface deposit of the chemical agent employed, such as a soap or surfactant. Superficial deposits of chemical cleaning agents are just as undesirable—and is some cases more—than the natural tissue and/or tissue film deposits.

The wearer of contact leanses faces some extreme problems in the area of hygiene and cleaning of the lenses. Both when in place in the eye and during handling, contact lenses are exposed to a number of materials which will adhere to the surface of the lens and accumulate to form a film which will gradually increase, interfering with the optical characteristics of the lenses and which may prove irritating to the eye of the wearer. Thus, a wide variety of cleaning formulations intended to remove such films from the lens surfaces are available to the contact lens wearer. Such preparations are ordinarily based on the action of a detergent composition or the like. The formulations presently available to the contact lens wearer have limited effectiveness in removing certain types of materials deposited on the lenses. Among the more difficult deposits are proteins, lipids and fats, all of which may be present on the surfaces of contact lenses by virtue of exposure to such materials in the tear fluid in the eye of the wearer and also from contact with the wearer's hands during handling, incident to insertion and removal of the lens and other manipulations such as cleaning and the like.

Surfactant and detergent based cleaning formulations are limited in their effectiveness presumably because of the inability of the user to "scrub" the surface of the lens. Any "scrubbing" to assist in the effectiveness of the cleaning formulation would run the risk of damaging the surface of the lens and is, of course, an entirely impractical adjunct to lens cleaning.

The advent of the gel contact lens have generated entirely new requirements for contact lens cleaning solutions and entirely new problems in hygienic handling and care for the lenses. In contrast to the more common hard type lens, usually made of polymethyl methacrylate, the gel lens will absorb relatively large proportions of water to form a soft pliable material which has a tendency to fray. The gel is a three-dimensional latice formed by the polymerization of glycol esters and diesters of acrylic acids. The glycol moiety of the molecules imparts a strong hydrophilic character to the latice with the consequent ability to absorb rather large amounts of water. By utilizing the unique properties of these lenses, new therapeutic options have been presented for the treatment of ocular debilities. Such lenses have become well known to those of ordinary skill in the art and a more complete discussion of the physical parameters need not be repeated here.

However, one characteristic peculiar to the gel lens is the requirement that treating solutions, and cleaning solutions in particular, contain no component that can become entrained in the latice of the gel since such materials tend to accumulate and become irritating to the ocular tissues. The lens does however require a cleaning solution to remove deposits and films of extraneous materials which themselves may tend to accumulate and irritate ocular tissues and which may interfere with optical properties. The exposure of the lens to atmospheric polutants; such as smoke, dust, pollen, noxious and irritating gases and the like, can result in accumulations at or near the surface of the lenses and can result in severe discomfort and irritation to the eye of the wearer's and such effects may well persist for substantial periods of time. Similar irritation can occur from accumulations from proteins, lipids, fats and starches on the surface of the lens.

DISCUSSION OF THE PRIOR ART

It is known to use a variety of enzyme formulations to clean prothesis devices including contact lenses. For example, U.S. Pat. Nos. 3,855,142 and 3,962,107 disclose enzyme formulations for cleaning dentures. The dentures are soaked in an aqueous medium containing the enzyme formulation for a sufficient time to remove organic deposits.

It has also been proposed to remove proteinaceous material from the surface of contact lenses by contacting the lenses with an aqueous solution of a protease such as papain. This technique is described in the Karageozian et al patent, U.S. Pat. No. 3,910,296.

SUMMARY OF THE INVENTION

Hydrophilic gel-type soft contact lenses are safely cleaned by treatment in an aqueous slurry of pancreatin. As pancreatin is but very sparingly water soluble, enzymes are not absorbed by the contact lenses, thus avoiding the problem of eye irritation often encountered with use of cleaners containing soluble enzymes.

The pancreatin is preferably used in tablet form, each tablet containing the equivalent of about 100 to 200 mg pancreatin of standard digestive power. This provides the proper concentration for cleaning a pair of contact lenses when slurried in 5–15 ml water. Tableting of the pancreatin is accomplished using a binder comprising a mixture of sodium chloride and boric acid.

Cleaning of lenses is accomplished by adding a pancreatin tablet to a suitable volume of water and immersing the lenses in the slurry of pancreation formed in the water by disintegration of the pancreatin tablet. Time required for cleaning is relatively short and cleaning is ordinarily complete within 10–30 minutes.

Thus, it is an object of this invention to provide a composition adapted for use in cleaning hydrophilic gel contact lenses.

It is another object of this invention to remove proteinaceous deposits from contact lenses using an enzyme cleaner while avoiding problems of eye irritation.

Yet another object of this invention is to provide a convenient and safe method for routine cleaning of soft contact lenses.

DISCUSSION OF THE INVENTION

The normal regimen for soft lens care requires both cleaning and sterilization. As has been discussed previously, proteinaceous deposits tend to form and build up on the lenses during wear and handling. Treatment of the lenses in an aqueous solution of an enzyme such as papain effectively removes such deposits.

Because the cleaning step does not kill bacteria and other microorganisms, there is also required a routine sterilization procedure which is normally performed after cleaning. Sterilization may be accomplished either thermally or chemically. Thermal sterilization usually comprises boiling the lenses in an isotonic saline solution. Chemical sterilization is ordinarily accomplished by soaking the lenses in solutions of chemical sterilizing agents such as chlorhexidine or thimerosal.

It has been reported that a significant increase in red eyes occurs when enzymatic contact lens cleaners containing soluble enzymes such as papain are used in conjunction with either thermal or chemical sterilization regimens.

Efforts to determine the cause of this increase in cases of eye irritation have produced data suggesting the occurrence of residual enzyme even after the thermal disinfecting procedure, but of even greater importance, a significant occurrence of residual enzyme after use of the chemical sterilization procedure. Initial studies indicate that the problem may well relate to either protein or thimerosal accumulation within the lens due to the increased residual enzyme. It does not appear that there is an increased buildup of chlorhexidine. Efforts are continuing to establish the exact cause for the reported clinical observations of increased red eye. At this time, the problem is considered to be of sufficient gravity to require warning labels on sterilant preparations recommending avoidance of enzymatic contact lens cleaners containing soluble enzymes such as papain when using those products.

It has been found that enzyme buildup within a soft contact lens can essentially be avoided by using pancreatin as the enzymatic cleaning agent. Thus, eye irritation resulting directly or indirectly from enzyme accumulation within the soft contact lens is avoided.

Pancreatin is often used as a digestive aid and occurs as cream-colored, amorphous powder having a faint but inoffensive odor. It hydrolyzes fats to glycerol and fatty acids, changes proteins into proteoses and related substances and converts starch into dextrins and sugars. It displays greatest activity in neutral or slightly alkaline media and is inert in the presence of small amounts of mineral acids or larger amounts of alkali hydroxides. An excess of alkali carbonate inhibits its action.

Pancreatin is obtained from the pancreas of the hog or the ox and comprises a mixture of enzymes. It displays significiant amylase lipase and protease activity. Pancreatin of standard digestive power contains in each mg not less than 25 NF units of amylase activity, not less than 2 NF units of lipase activity and not less than 25 NF units of protease activity. Pancreatin is a commercially available product.

It is not clearly understood precisely why pancreatin when used as an enzymatic cleaner for soft contact lenses avoids the problems of eye irritation encountered with other enzymatic cleaners. It is believed that the solubility relationships of pancreatin as compared to enzymes such as papain are a significant factor, as pancreatin is but very sparingly soluble under the conditions of use. It is also theorized that the source of the enzyme may have significance. Pancreatin is obtained from a mammalian source, while papain is derived from a vegetable source and other enzymes are derived from microorganisms. It is known, for example, that enzymes from different sources display differing activity toward specific proteinaceous materials.

When using pancreatin as a contact lens cleaning agent, it is highly advantageous to formulate the pancreatin in tablet form. Each tablet contains the proper amount of pancreatin for a single cleaning of a pair of contact lenses. By formulating the pancreatin in this fashion, there is avoided the problems of over or under use during lens cleaning procedures.

The amount of pancreatin per tablet, or per use, may range from about 100 to 200 mg equivalent of standard digestive power with a preferred amount being approximately 150 mg. Tablets are formed in conventional fashion using inert and innocuous binding and filling agents. A preferred binding and filling agent comprises a mixture of sodium chloride and boric acid. Sodium borate may also be used in admixture with the other binders. Sodium chloride and boric acid when used as binding agents for pancreatin provide a unique interaction of physical and chemical characteristics. They effectively act as binders for pancreatin so that it may be readily tableted, are very soluble so that the tablet readily disintegrates in water to form a slurry of pancreatin and provide an essentially isotonic solution of proper acidity which is compatible with eye fluids.

Amount of binding agent used is not critical but must be adequate to insure physical integrity of the tablets during normal storage and handling and provide an eye-compatible solution when the tablet is dispersed in water. It has been found that about 100–150 mg of a mixture of the above-named binding agents is about optimum for forming a tablet having an excellent physical integrity and displaying rapid and complete disintegration is about 10 ml water to form an essentially isotonic solution.

While pancreatin of various sources can be used, it is preferred to form the tablets from pancreatin, sold by the Viobin Corporation, Chicago, Ill., under the trade designation 4X. Preference for this particular product is based upon its superior tableting characteristics when compounded with sodium chloride, boric acid and, optionally, sodium borate.

The designation 4X refers to pancreatin having a concentration four times that of the standard digestive power. It has been found that pancreatin of lower concentration or lower digestive power will not tablet properly. Use of pancreatin 3X, for example, results in tablets having such low physical strength that powdering and disintegration occurs during normal handling.

A preferred tablet composition contains from 25 to 50 mg pancreatin 4X, which is equivalent to 100 to 200 mg pancreatin of standard digestive power. The tablet also contains, as binding materials, sodium chloride and boric acid in an amount ranging from 60 to 145 mg and 12 to 25 mg respectively. It is preferred that the ratio of sodium chloride to boric acid, in the tablet, be in the range of 4:1 to 6:1. A most preferred composition comprises a tablet containing 35 to 40 mg pancreatin 4X, 100 to 115 mg sodium chloride and 18 to 22 mg boric acid. These preferred compositions can be readily tableted on standard presses, display good physical integrity and readily disintegrate when immersed in water.

Cleaning of soft contact lenses is accomplished by adding a tablet to a small amount, 5 to 15 ml, of either water or isotonic saline solution to form a slurry or suspension of pancreatin. Thereafter, the lenses are immersed in the solution for a time sufficient to remove proteinaceous deposits. It is preferred to use about 10 ml of liquid when using a tablet containing about 150 mg pancreatin of standard digestive power equivalent. Time required to complete the cleaning ranges generally from about 10 minutes to 2 hours and depends somewhat upon the tenacity and amount of proteinaceous materials on the lenses. No advantages are gained by extending the contact time beyond about 2 hours and cleaning is usually complete in less than 30 minutes.

After cleaning, the lenses are removed from the pancreatin slurry and are rinsed to remove all pancreatin present on the lens surfaces. Water may be used as the rinsing agent, but it is preferred that the rinse be accomplished using sterile, isotonic saline solution. Thereafter, the lenses are sterilized in the usual fashion using either thermal or chemical regimens and stored until next use.

Soft, polymer gel contact lenses cleaned in the above-described manner have been found to be free of residual enzyme. Because the tablet binder consists only of sodium chloride and boric acid, which have been long known to be compatible with eye fluids, there is avoided any potential hazard of binder absorption within the contact lenses. Thus, problems of eye irritation attributable to enzyme retention or binder absorption in the lenses is effectively obviated.

What is claimed:

1. A composition in tablet form consisting essentially of 25–50 mg pancreatin 4X, 60–145mg sodium chloride and 12–25 mg. boric acid.

2. The composition of claim 1 containing 35 to 40 mg pancreatin 4X, 100 to 115 mg sodium chloride and 18 to 22 mg boric acid.

3. A method for removing proteinaceous deposits from hydrophilic polymer gel contact lenses comprising:

dispersing an effective cleaning amount of an eye-compatible enzyme formulation in water to form a slurry, said formulation being in the form of a tablet consisting essentially of pancreatin 4X, sodium chloride and boric acid;

contacting said lenses with said slurry for at least 10 minutes to remove said proteinaceous deposits; and rinsing the cleaned lenses to remove pancreatin from the lens surfaces.

4. The method of claim 3 wherein said tablet contains 25 to 50 mg pancreatin 4X, 60 to 145 mg sodium chloride and 12 to 25 mg boric acid, and wherein the tablet is dispersed in 5 to 15 ml water.

5. The method of claim 3 wherein said tablet contains 35 to 40 mg pancreatin 4X, 100 to 115 mg sodium chloride and 18 to 22 mg boric acid.

6. The method of claim 4 wherein said tablet is slurried in approximately 10 ml water.

7. The method of claim 3 wherein said lenses are rinsed with a buffered isotonic saline solution.

* * * * *